United States Patent [19]

Fitchett

[11] 4,118,692

[45] Oct. 3, 1978

[54] BAG ALARM DEVICE

[76] Inventor: Arthur B. Fitchett, 2944 Willie Mays Pkwy., Orlando, Fla. 32805

[21] Appl. No.: 782,503

[22] Filed: Mar. 29, 1977

[51] Int. Cl.[2] ..... G08B 21/00

[52] U.S. Cl. ..... 340/542; 340/568; 109/43; 150/42; 200/161

[58] Field of Search ..... 340/280, 283; 200/61.74, 61.76, 61.85, DIG. 2, 161; 109/43; 116/99, 77, 44, 75; 150/42, 46, 35, 47, 26; 190/42

[56] References Cited

U.S. PATENT DOCUMENTS

| | | | |
|---|---|---|---|
| 1,148,773 | 8/1915 | Helmers | 109/43 |
| 1,730,745 | 10/1929 | Ducek | 340/280 |
| 3,701,140 | 10/1972 | Dixon | 340/283 |
| 3,815,118 | 6/1974 | McDonald | 340/280 |
| 3,893,096 | 7/1975 | Tucci et al. | 340/283 |
| 3,938,126 | 2/1976 | Ransom | 340/280 |

*Primary Examiner*—John W. Caldwell, Sr.
*Assistant Examiner*—Donnie L. Crosland
*Attorney, Agent, or Firm*—Robert D. Farkas

[57] ABSTRACT

A bag alarm device utilizes a bar slideably affixed to the interior surface of a closure flap of a handbag extending outwardly from the marginal edge thereof. A pair of electrical contacts are urged into a closed position when the free end of the bar is pulled outwardly from the marginal edge of the flap by unauthorized means other than releasing the free end of the bar from locking engagement with a lock secured to the body of the bag. Closure of the contacts is maintained until the bar is permitted to return to its normal unextended position following opening the lock and releasing the bar in an authorized manner. An alarm device, including audible and visual alarms, is energized by a battery carried by the bag when the contacts are in the closed position.

7 Claims, 3 Drawing Figures

BAG ALARM DEVICE

BACKGROUND OF THE INVENTION

1. The Field of the Invention

This invention relates to bag alarm devices and more particularly to that class operable upon an attempt to open the bag in an unauthorized fashion.

2. Description of the Prior Art

The prior art abounds with anti-theft devices which signal the attempted unauthorized removal of a bag from the possession of the owner and the unauthorized opening of the bag. U.S. Pat. No. 3,701,140 issued on Oct. 24, 1972 to R. W. Dixon discloses an audible alarm constituting a part of a lady's purse and so constructed that a sudden pull or kerking force exerted on the purse handle will cause the alarm to be actuated. The alarm unit is so constructed that it will continue to operate until a part of the unit is dismantled to effect a deactivation of the alarm.

U.S. Pat. No. 3,893,096 issued on July 1, 1975 to D. Tucci et al teaches a handbag alarm system for handbags which are closed by a clasp, including an alarm electrically coupled to a direct current source, an on-off deactivating switch, and a pressure responsive switch to provide positive and reliable actuation of the alarm, indicating unauthorized opening of the handbag.

Both of the aforementioned patents serve dissimilar purposes. The Dixon disclosure sounds an alarm upon the application of a sudden pull on a purse handle and the Tucci patent sounds an alarm upon the unauthorized opening of the bag. The Tucci apparatus however, requires the user to purposefully shut off the alarm on each occasion that the bag is to be opened in an authorized manner.

SUMMARY OF THE INVENTION

A primary object of the present invention is to provide a bag alarm device which does not interfere with the normal use of the bag.

Another object of the present invention is to provide a bag alarm which activates only when the bag is opened or attempted to be opened in an unauthorized fashion.

Still another object of the present invention is to provide a bag alarm device which need not reveal the presence of such a device mounted to the bag.

Yet another object of the present invention is to provide a bag alarm device in accordance with the preceding objects, which is simple in construction, relatively inexpensive and effective for its particular purposes.

Most bags of good quality are provided with locks in one form or another. The locks may be of the combination variety, key operated variety, or a simple twist cam lock amongst others. Common to each of the most popular locks is a bar which extends from the flap closure of the bag adapted to be releasably secured to the body of the bag by the lock mechanism. The present invention provides an apparatus which senses a substantial pull-like force being exerted upon the bar when an attempt is made to open the bag by means other than releasing the bar from the lock mechanism in an authorized manner. By retaining the bar in its "pulled" position, the alarm will continue to sound, or visibly signal, until such time that the bag is opened in an authorized fashion and the bar is permitted to return to its normal "unpulled" position.

These objects as well as other objects of the present invention, will become more readily apparent after reading the following description of the accompanying drawings.

DESCRIPTION OF THE PREFERRED EMBODIMENT

The structure and method of fabrication of the present invention is applicable to a bar having a substantially T-shape whose leg is adapted to slide within a cavity formed by a U-shaped bracket secured adjacent a marginal edge to the internal surface of a closure flap of a bag. The "cap" of the T prohibits the bar from unlimited extension in the direction outwardly from the marginal edge of the flap. A helical spring urges the bar so that the free end of the bar is pulled towards the marginal edge of the flap. One marginal edge of the leg of the bar is serrated such that the serrations are engaged by the cam-like end of a pawl spring biased inwardly toward the serrations. The other end of the pawl is fitted with an arm which when manipulated permits the cam-like end of the pawl to disengage from the serrations. The pawl is pivotably secured, intermediate its ends to the interior surface of the flap. Thus, the bar can be maintained in a normal extended position by the pawl engaging one serration and urged into a locking position by the action of the spring on the bar. The bar may be pulled outwardly from the marginal edge of the flap causing the pawl to engage another serration, locking the bar in the super extended position.

A pair of contacts are secured to the internal surface of the flap and electrically engage the cap end of the bar when the bar is in the super extended position. The free end of the bar, adjacent the leg of the T-shape thereof, is adapted to engage a combination lock mounted on the surface of the body of the bag in a normal fashion. Application of an unauthorized opening force causes the bar to extend outwardly, into the super extended position, electrically connecting the contacts together, energizing an alarm apparatus by a power source, carried by the bag. The alarm apparatus includes an audible alarm, and if desired, a visual alarm connected in parallel therewith.

Figure 1:
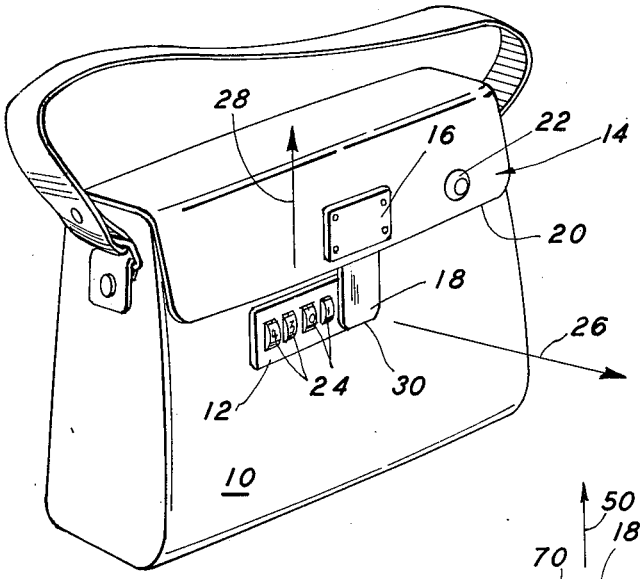
FIG. 1 is a perspective view of the present invention shown mounted to a closed bag.

Now referring to the figures, and more particularly to the embodiment illustrated in FIG. 1 showing a bag 10 having a combination lock 12 affixed to a body portion thereof. A closure flap 14 is adapted with plate 16 utilized to mount bar 18 thereto. Marginal edge 20 of the flap is shown adjacent to lock 12. Lamp 22 is shown mounted to closure flap 14. In normal use, tumblers 24 are disposed into the correct position permitting bar 18 to disengage from lock 12 by moving in the direction of arrow 26. An unauthorized force, in the direction of arrow 28, applied to flap 14, causes the distance between point 30 on bar 18 and marginal edge 20 to increase.

Figure 2:
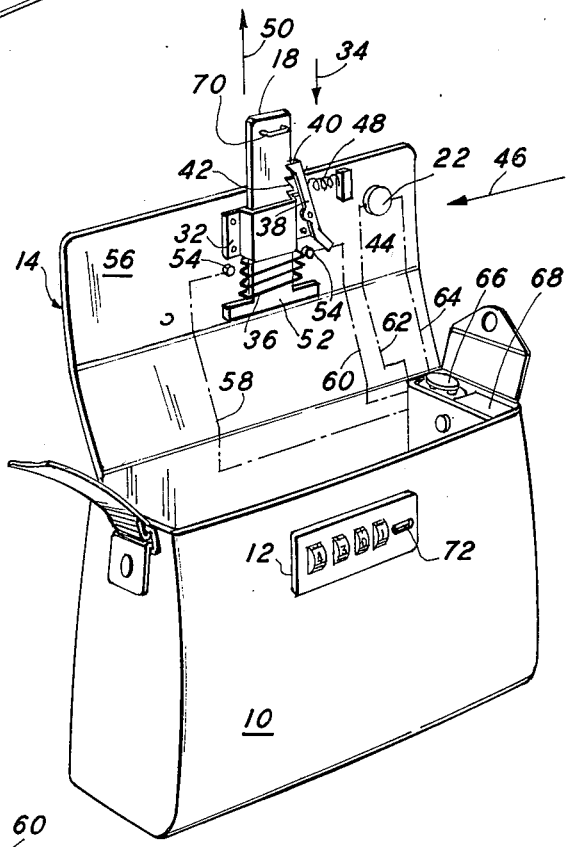
FIG. 2 is a perspective view of the present invention illustrating the bag, shown in FIG. 1, in an opened condition.

FIG. 2 shows bar 18 disposed partially within U-shaped bracket 32 and urged in the direction of arrow 34 by the action of spring 36. Pawl 38 is adapted with a cam-like end 40 engaging selectively one of serrations 42. Arm 44, when depressed in the direction of arrow 46, overrides the expansive properties of spring 48, thereby permitting cam-like end 40 from disengaging said one serration. When a force is applied to bar 18 in the direction of arrow 50, the cap end 52 of the bar, electrically interconnects contacts 54 secured to the interior surface 56 of closure flap 14. Dotted lines 58 and 60 signify conductors concealed within the walls of the bag as do dotted lines 62 and 64 coupled to lamp 22. Battery 66 and audible alarm device 68, such as a buzzer, are shown mounted to the interior surface of the body of the bag. Tongue 70, affixed to bar 18, is adapted to enter slot 72 to be captured by the locking mechanism of lock 12.

Figure 3:
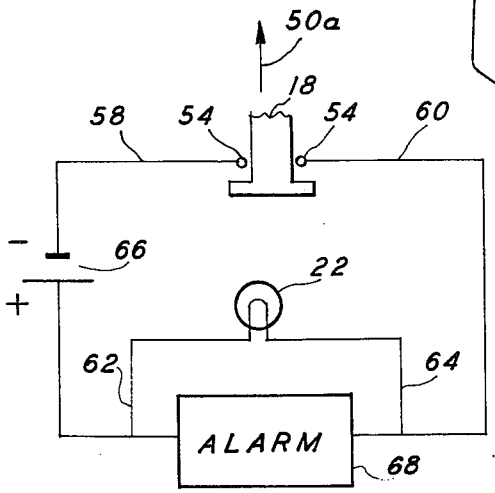
FIG. 3 is a schematic diagram of the electrical components utilized in the present invention.

FIG. 3 illustrates battery 66 in a series electrical circuit with contacts 54, adapted to be joined together electrically when bar 18 is moved upwardly in the direction of arrow 50*a*. Audible alarm 68 is shown in series with contacts 54 and battery 66. Wires 62 and 64 are shown connecting lamp 22 in parallel with alarm 68, if a visual alarm is desired.

One of the advantages of the present invention is a bag alarm device which does not interfere with the normal use of the bag.

Another advantage of the present invention is a bag alarm device which activates only when the bag is opened or attempted to be opened in an unauthorized fashion.

Still another advantage of the present invention is a bag alarm device which need not reveal the presence of such a device mounted to the bag.

Yet another advantage of the present invention is a bag alarm device in accordance with the preceding advantages, which is simple in construction, relatively inexpensive and effective for its particular purposes.

Thus there is disclosed in the above description and in the drawings, an embodiment of the invention which fully and effectively accomplishes the objects thereof. However, it will become apparent to those skilled in the art, how to make variations and modifications to the instant invention. Therefore, this invention is to be limited, not by the specific disclosure herein, but only by the appending claims.

I claim:

1. A bag alarm device comprising means mounted on said bag to provide a source of direct current, alarm means mounted on said bag and electrically connected to said direct current means, pull responsive switch means mounted on a closure flap of said bag, said pull responsive switch means having an elongated external component having a logitudinal axis, said component extending outwardly from said closure flap, a portion of said external component releasably locked with a lock secured to a surface portion of the outside surface of said bag when said closure flap is overlying said surface portion thereby maintaining said bag in a closed condition, a set of contacts being maintained in an open circuited condition when said portion is locked with said lock, said set of contacts being disposed in a closed circuited condition upon the application of a pulling force applied to said closure flap in a direction of the longitudinal axis of said component tending to dispose said portion of said component further outwardly from said closure flap whilst said portion of said component is maintained locked with said lock, means to releasably maintain said set of contacts in said closed circuited condition following said application of said force, means to unlock said lock, releasing said portion therefrom without disposing said set of contacts into said closed circuited condition, said set of contacts connected to said alarm means.

2. The bag alarm device as claimed in claim 1 wherein said lock is a combination lock.

3. The bag alarm device as claimed in claim 1 wherein said external component comprises a T-shaped bar having marginal edges, a U-shaped bracket fixedly secured to an internal surface of said closure flap, one of said marginal edges having saw tooth serrations therein, said bar being disposed in sliding engagement within a cavity formed by said bracket and said internal surface, a pawl pivotably secured to said internal surface, said pawl having a cam-like end, first means to bias said cam-like end into said serrations, said set of contacts including a pair of stationary contacts fixedly secured to said internal surface, second means to bias said portion of said component towards said cavity along said longitudinal axis of said component, a part of said bar electrically connecting said pair of stationary contacts together when said portion is urged in a direction away from said cavity whereby said pawl and said serrations maintain said pair of stationary contacts and said part of said bar in electrical engagement thereby.

4. The bag alarm device as claimed in claim 3 wherein said releasable contact maintaining means comprises an arm fixedly secured to said pawl, said pawl releasing said pair of stationary contacts from said electrical engagement with said portion of said bar when said arm is manually depressed disengaging said cam-like end from said serrations.

5. The bag alarm device as claimed in claim 1 wherein said alarm means comprises an audible tone generating apparatus.

6. The bag alarm device as claimed in claim 5 further comprising a visible light generating device.

7. The bag alarm device as claimed in claim 1 whereby said component is slideably affixed to said closure flap and whereby said portion thereof extends outwardly from a marginal edge of said flap.

* * * * *